United States Patent [19]

Bull

[11] Patent Number: 4,712,394

[45] Date of Patent: Dec. 15, 1987

[54] SURF LOCK

[76] Inventor: David R. Bull, 226 4th St., Hermosa Beach, Calif. 90254

[21] Appl. No.: 924,017

[22] Filed: Oct. 28, 1986

[51] Int. Cl.[4] ..... E05B 73/00

[52] U.S. Cl. ..... 70/18; 70/58; 441/74

[58] Field of Search ..... 70/14, 18, 30, 49, 57, 70/58; 441/74

[56] References Cited

U.S. PATENT DOCUMENTS

| | | | |
|---|---|---|---|
| 3,742,740 | 7/1973 | Pyzal | 70/58 |
| 3,748,876 | 7/1973 | Mathews | 70/18 |
| 3,798,934 | 3/1974 | Wright | 70/59 |
| 4,340,376 | 7/1982 | Williams | 441/74 |

*Primary Examiner*—Robert L. Wolfe
*Attorney, Agent, or Firm*—John E. Halamka

[57] ABSTRACT

An improved arrangement for providing a securing tie point for a long, broad, flat object such as a surfboard. The sleeve may be mounted in a user prepared passage way in the object. The sleeve is basically a hollow cylinder into which a plug is detachably insertable. A securing cable may be passed through the sleeve and around a fixed object to secure the long, broad object. The plug is held in the sleeve with an o-ring. A catch and latch may be used in place of the o-ring. The sleeve may have mounting guides to aid in centering the sleeve in the passage way. The sleeve may be tapered to force the mounting adhesive between the sleeve and the passage way. The plug may contain a leash pin to provide a tie point for a leash between the object and the user. The plug and sleeve may contain a key and guide to aid the proper orientation of the plug into the sleeve. After mounting, the plug and sleeve may be sanded to conform to the surface of the long, broad object.

23 Claims, 17 Drawing Figures

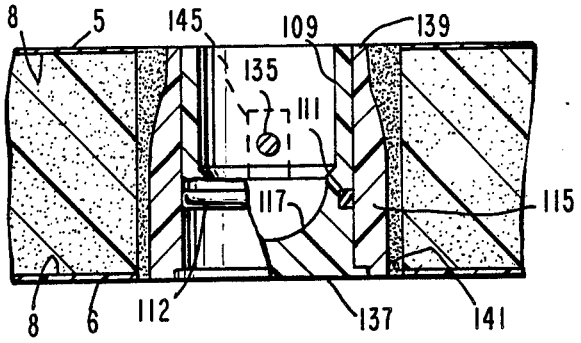
Fig. 5.
Fig. 6.
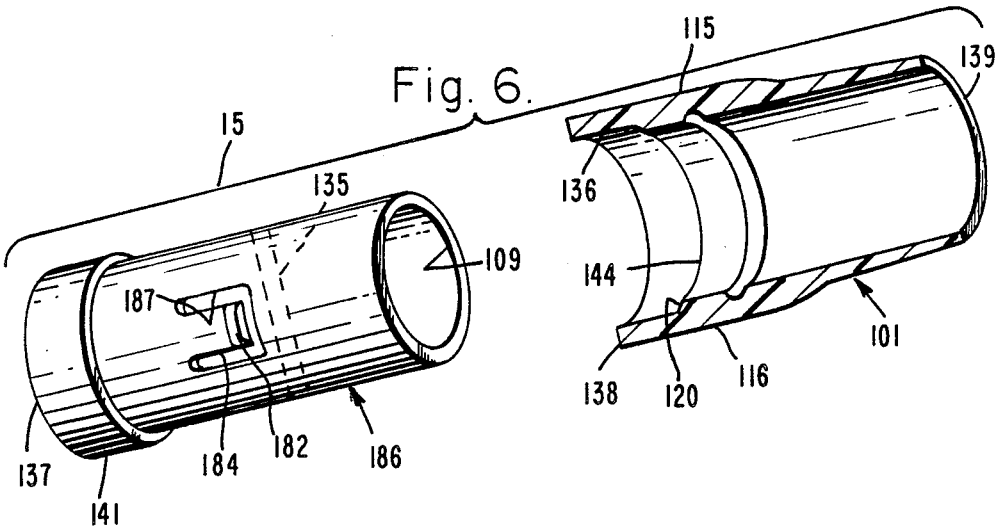
Fig. 7.
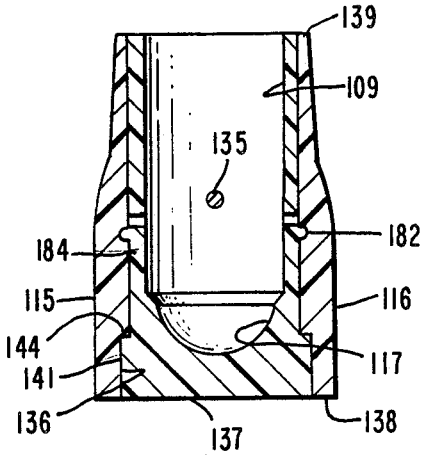
Fig. 8.
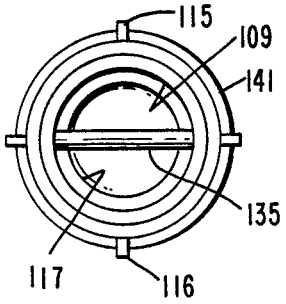

Fig. 13.
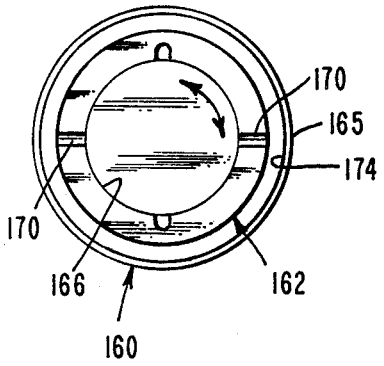
Fig. 14.
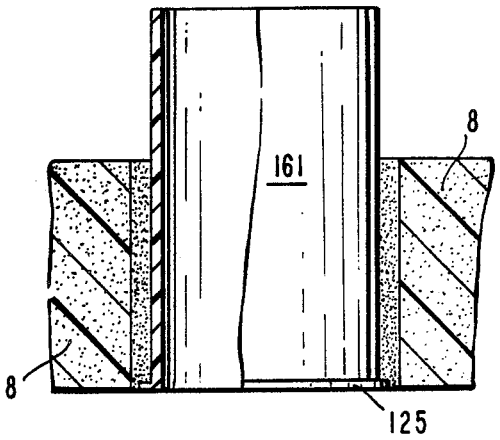
Fig. 15.
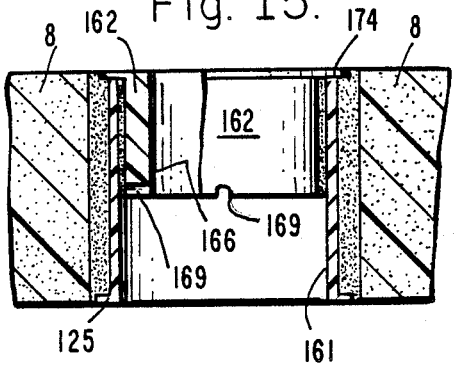
Fig. 16.
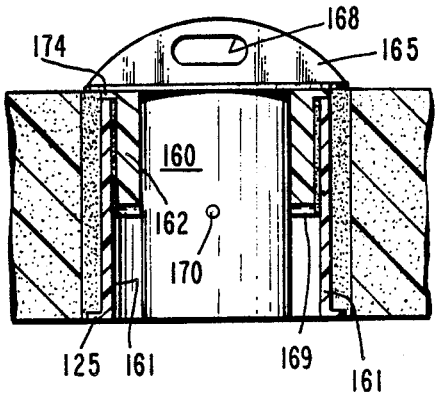
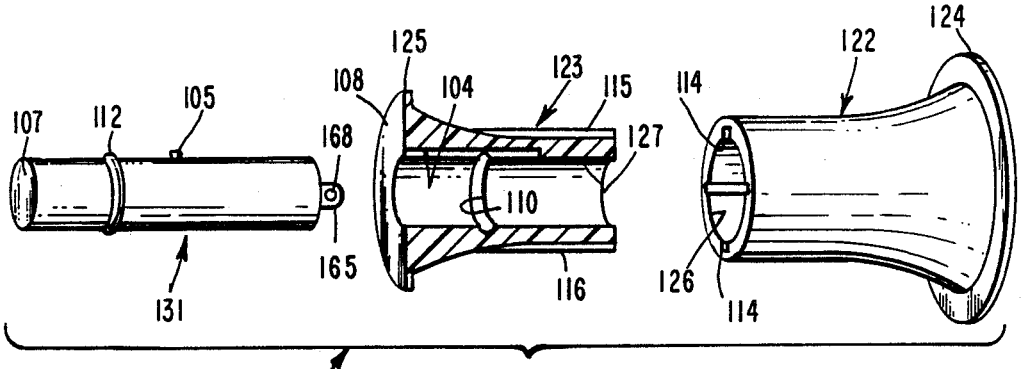
Fig. 17.

SURF LOCK

BACKGROUND OF THE INVENTION

1. Field of the Invention

This invention relates to the security art and, more particularly, to an improved arrangement for providing a securing tie point for a long, broad, flat object such as a surfboard to be used to lock said object to a fixed object.

2. Description of the Prior Art

The security of objects has become increasingly a concern. Objects which are to maintain a hydrodynamic or aerodynamic surface have been difficult to secure. U.S. Pat. Nos. 4,031,720 and 4,057,984 teach the securing of a pair of skis around a rail. The object securing the skis is limited in scope to be a thin rail which itself is adequately secured. The skis are secured together by a locking mechanism mounted in each sky. When the skis are unlocked, no provision is made to return the undersurface of the skis to a smooth hydrodynamic surface.

U.S. Pat. No. 4,340,376 teaches the securing of a surfboard equipped with an adjustable fin. A special padlock eye is attached to the adjustable surfboard fin holder. As the eye is positioned on the underside of the surfboard, it must be removed if the original hydrodynamic capabilities of the surfboard are to be maintained during use. This would require the installation and removal of the eye each time the surfboard is secured then unsecured for use.

Some users have locked objects with chains or cables by providing a channel through the object. However, this method did not provide for returning the surfaces of the object back to their original hydrodynamic or aerodynamic configuration. Further, breaking the hard outside seal on objects such as a surfboard exposes the soft internal form and may lead to deterioration of the object.

Some surfboards and bodyboards (also know as boogie boards, Boogie is a registered tradmark) are equipped with a leash tie point. However, most leash points are simply a thin pin to which a leash may be attached. Attaching a chain or cable to a leash pin is difficult and provides little or no security. The leash pin can be ripped from its mounting without diminishing the function and usefulness of the bodyboard.

Thus, there has long been a need for a providing a securing tie point for a long, broad, flat object which may be used to lock the object to a fixed object.

Further, it is also desired, after the object is removed from its secured position, to reconfigure the object to a hydrodynamic or aerodynamic surface on both the upper and lower sides of the object.

Further, is is also desired that the material used in the tie point construction be compatible with the material used in the construction of surfboards and bodyboards.

Additionally, it is desired to provide a leash tie point to the security tie point in order to achieve multiple use.

It is a further object of the invention to provide a light weight device which cannot be removed from the object without destroying the usefulness of the object.

It is yet another object of the invention to provide a device with no loose parts and which is quick and easy to operate within a beach environment of sand, salt water and sun.

SUMMARY OF THE INVENTION

Accordingly, it is an object of the present invention to provide a securing tie point for a long, broad, flat object such as a surfboard, sailboard or bodyboard which may be used to lock the object to a fixed object.

It is another object of the present invention to provide an arrangement which may be reconfigured to provide hydrodynamic or aerodynamic surfaces after the object is removed from its secured position.

It is yet another object of the present invention to provide a leash tie point upon reconfiguration of the security tie point. A leash is a means of attaching the object to the user whereby the user may easily retrieve the object should the user and the object become separated during use.

It is yet another object of the present invention to provide material and a configuration compatible with the materials used in the construction of surfboards and bodyboards.

The above and other objects of the present invention are achieved, according to a preferred embodiment thereof, by providing an arrangement of a mountable sleeve and a plug constructed from a material which may be sanded.

The sleeve may be a hollow cylinder mountable in a passage way drilled through the object. The outside surface of the cylinder may contain raised portions to aid in centering and securing the sleeve within the passage way. The sleeve is fixed in the passage way with an adhesive material such as cabosil which may be colored, if desired, to esthetically conform to the coloration of the object. The sleeve may be wedge shaped to aid in forcing the cabosil to conform to the area between the inside surface of the passage way and the outside surface of the sleeve.

The sleeve may contain steps to further hold the mounted sleeve in the passage way after the cabosil dries. The steps may be near the ends of the sleeve so that the portion nearest the upper and lower surface of the object may have a thicker layer of cabosil to improve the waterseal between the exposed ends of the passage way and the sleeve.

After the sleeve is mounted in the object, the sleeve provides a channel in the object through which a cable or chain may pass. The cable or chain may then be used in conjunction with a padlock to secure the object to a fixed object.

The plug is configured to be insertably removable from the inside channel of the sleeve.

If the object is tapered, and the plug is not inserted in the correct orientation, a lip will protrude which may interfere with the use of the object. To assist in the correct orientation of the plug during insertion into the sleeve the inside of the sleeve may be constructed with a guide slot and the plug may include a key compatible with the guide slot.

A stop means may be incorporated into the sleeve so that upon full insertion the bottom end of the plug may be aligned adjacent to the underside of the object to provide a hydrodynamically smooth under-surface. Additionally the bottom end of the plug may include a section of a preselected length having a diameter larger than the diameter of the remaining length of the plug and corresponding to a larger opening in the sleeve to prevent the plug from being pulled completely through the sleeve. The other end of the plug adjacent to the topside of the object may include a leash pin to which a leash line may be secured during the use of the object. Or the leash pin may be mounted in a leash plug insertably removable from the top side of the sleeve or plug.

The plug and sleeve arrangement may include a latch to hold the plug within the sleeve.

The arrangement may be constructed from a material containing 30% glass filled polycarbonate. This type of material can be sanded without melting. The unmounted length of the plug and sleeve may be longer than the nominal thickness of the object. After the sleeve is mounted in the object and the plug is inserted into the sleeve, the topside and underside of the arrangement may be sanded to conform the upper and lower surface of the arrangement to the adjacent surface of the object.

The sleeve may have flanges mounted on the ends so that it may be mounted in soft objects such as a bodyboard. The flanges distribute the stress to prevent the arrangement from pulling through the softer material. The sleeve may be constructed of two or more parts so that the parts with flanges may be mounted into the bodyboard from each side. The parts may be glued together.

BRIEF DESCRIPTION OF THE DRAWING

The above and other embodiments of the present invention may be more fully understood from the following detailed description, taken together with the accompanying drawing, wherein similar reference characters refer to similar elements throughou, and in which:

FIG. 5 is a cross sectional side view of the prefered arrangement mounted in a surf board with the plug inserted into the sleeve;

FIG. 6 is perspective side view of a plug with tabs which contain ridges and a cross sectional perspective view of the sleeve with corresponding catch;

FIG. 7 is a cross sectional view of the plug inserted into the sleeve of FIG. 6;

FIG. 8 is an end view of the open end of the plug inserted into the sleeve of FIG. 6;

FIG. 13 is a bottom view of the upper piece of the sleeve with plug inserted;

FIG. 14 is a cross sectional view of the lower piece of the sleeve mounted in a surfboard;

FIG. 15 is a cross sectional view of the lower and upper piece of the sleeve mounted in a surfboard;

FIG. 16 is a cross sectional view of the embodiment of FIG. 12 mounted in a surfboard; and FIG. 17 is a perspective side view of a sleeve formed of two parts, each with a flange and a plug.

DESCRIPTION OF A PREFERRED EMBODIMENT

Figure 1:
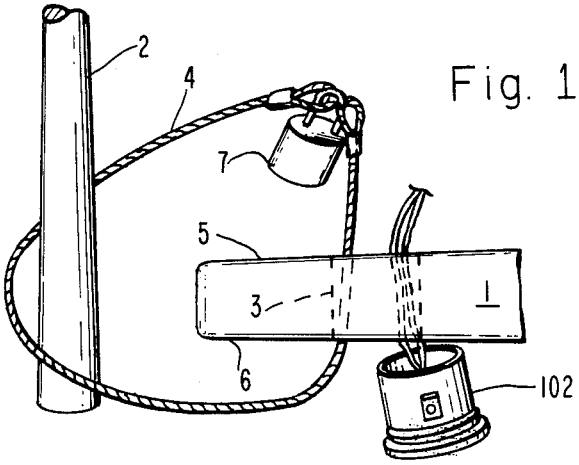
FIG. 1 is a perspective view of a typical surfboard locked to a fixed object by means of the present invention.

Referring now to the drawing, there is illustrated in FIG. 1 a depiction of a surfboard 1 containing the present invention locked to a fixed object 2. The present invention provides a passage way 3 through the surfboard 1 extending from the upper surface 5 to the lower surface 6 and may accommodate a chain or cable 4. The inside diameter of the passage way is selected to accommodate the nominal width of chain and cable with loops which are used to secure items such as bicycles to fixed objects. One end of the chain or cable is threaded through the passage way provided by the present invention. The ends of the chain or cable 4 are then wrapped around a fixed object 2 and secured by a lock means 7.

Figure 2:
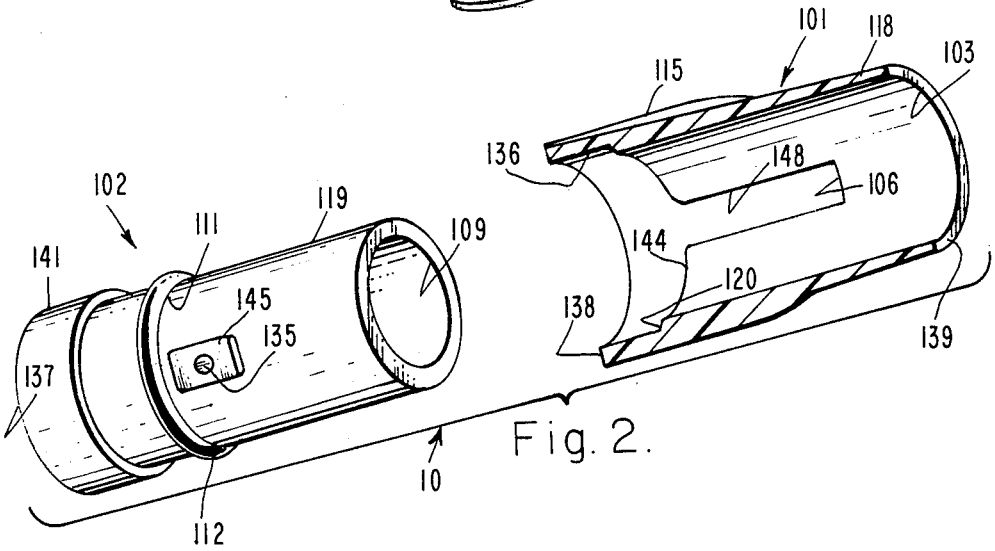
FIG. 2 is a perspective side view of the prefered arrangement of a plug and a cross sectional perspective side view of the sleeve.
Figure 3:
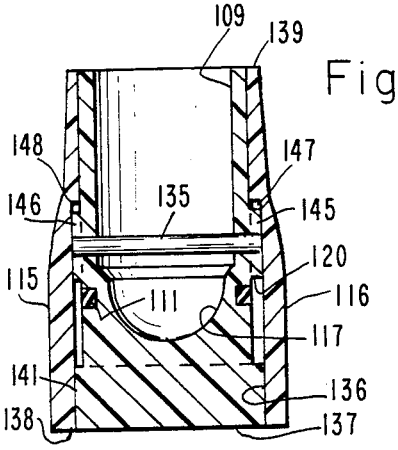
FIG. 3 is a cross sectional side view of the prefered arrangement with the plug inserted into the sleeve.

An embodiment of the invention is shown in FIG. 2 as the preferred embodiment 10 of a sleeve 101 and a plug 102. The sleeve 101 is comprised of a unitarily fabricated body having a cylindrical shape with a preselected outside diameter nominally in the range of 1 and $\frac{1}{4}$ to 1 and $\frac{3}{4}$ inches and a first inside surface generally designated 103 of a preselected inside diameter nominally in the range of 1 to 1 and $\frac{1}{2}$ inches. Walls 148 form a second guide slot in the first inside surface 103 of a preselected width and depth. Walls 147 shown in FIG. 3 form a first guide slot of a preselected width larger than the width of the second guide slot 148. The sleeve 101 contains a series of internal walls of decreasing inside diameters shown in the cross sectional view FIG. 3

Plug 102 is comprised of fabricated body having a preselected outside diameter smaller than the inside diameter of the first inside surface 103 of the sleeve 101. Plug 102 is insertably removable from the inside of the sleeve 101. The tolerance used to fabricate the preferred embodiment of the present invention is critical to allow a slip fit of the plug 102 into the sleeve 101 and not allow an accumulation of salt, dirt or sand to prevent the removal of the plug 102 from the sleeve 101. In the preferred embodiment, the first inside surface 103 of the sleeve 101 is fabricated to be $\pm 0.002$ inches of the preselected inside diameter. The second outside surface 119 of the plug 102 is fabricated to be $\pm 0.005$ inches of the preselected outside diameter of the plug 102.

The longitudinal length of the sleeve 101 is preselected so that under the condition of the first end 138 being adjacent to the bottom surface of a long, broad object, the second end 139 is adjacent to the top surface of said object. For tapered objects such as a surfboard, the longitudinal length of the sleeve and corresponding plug are selected to be longer than the thickness of the surfboard in the area where the sleeve is normally mounted in the surfboard. After mounting of the sleeve into the surfboard and insertion of the plug into the sleeve, the exposed ends of the longer sleeve and plug are sanded to conform to the taper of the surfboard to provide a hydrodynamic surface on both the bottom and top sides of the object.

The plug 102 is fabricated with a plug cap 141 on the end of the main body of the plug 102. Third walls 111 form a circumferential seat in the outside surface of the main body of the plug 102. The dimensions of the seat circumferential 111 are selected to hold an O-ring 112 in place. The O-ring 112 is fabricated of elastic material and deforms against inside surface 103 when the plug 102 is inserted into the sleeve 101 thus acting as a catch and holding the plug 102 inside the sleeve 101.

The tolerance of the fabrication of the third walls 111 to form the circumferential seat is critical for the proper friction fit of the plug mounted o-ring 112 into the sleeve 101. In the preferred embodiment, the circumferential seat 111 may conform within 0.005 inches of the preselected dimensions.

The fifth inside wall 133 of the sleeve 101 forms an opening to accommodate the plug cap 141. A plug stop 144 is formed at the end of the fifth inside walls 133 at a preselected distance so that when the plug 102 is inserted into the sleeve 101, the bottom 137 of the plug 102 is substantially adjacent to the first end 138 of the sleeve 101.

The leading edge of the first inside wall 103 is fabricated to contain a chamfer 120 to ease the insertion of O-ring 112 without damage. Sixth inside wall 136 forms a chamfer on the working edge of the inside bottom surface of the sleeve 101 to ease the installation of the plug 102 into the sleeve 101. The chamfer 136 also prevents the chipping of the working edge which may hinder the insertion and removal of the plug 102.

The plug 102 is fabricated with a first key 145 of a preselected width to fit into the first guide slot 147 but not the second guide slot 148. The plug 102 may contain a second key 146 positioned to fit into the second guide slot 148 as the first key 145 is fitted into the first guide slot 147. Each key is mounted on the outside surface of the main body of the plug 102 spaced apart from the bottom 137.

Figure 4:
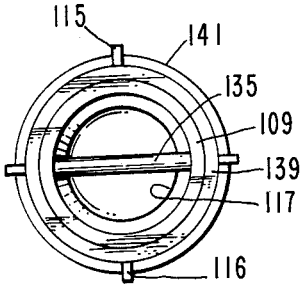
FIG. 4 is an end view of the open end of the plug as inserted into the sleeve containing mounting guides.

FIG. 4 illustrates a top view of the plug 102 inserted into sleeve 101. The leash pin 135 is mounted through the plug 102 at the position of the keys to take advantage of the extra thickness of the material used to form the keys. Reinforcements may be added to the second inside surface 109 of the plug at the point the leash pin 135 is mounted to increase the amount of stress which may be placed upon the leash pin 135.

The second inside surface 109 of the plug 102 is a preselected inside diameter or series of decreasing inside diameters to accommodate a leash line tied around the pin 135. The end wall 117 may be curved to accommodate the return of the end of the leash line being pushed along one side of the leash pin 135 so that the leash line is redirected to travel along the other side of the leash pin 135. This redirected leash line may then be tied to the leash pin 135.

The user must prepare the long, broad object to accept the sleeve 101. As shown in FIG. 5, the user may drill a passage way 3 from the lower surface 6 of the object to the upper surface 5 of the object. The inside diameter of this passage way must be larger than the outside diameter of the sleeve 101. To accommodate the sleeve 101, a preselected inside diameter of this passage way from 100.1 to 150% or more of the outside diameter of the sleeve 101 should be used. The embodiment 10 shown in FIG. 4 depicts a plurality of mounting guides 115 formed on the outside surface of the sleeve 101. The thickness of the mounting guides 115 is preselected to allow the user to insert the sleeve 101 with mounting guides 115 into the user prepared passage way such that the guide outside surface 116 is adjacent to the inside surface of the user prepared passage way as shown in FIG. 5. The user prepared passage way could be smaller than the outside diameter of the mounting guides 115 so that after insertion of the sleeve 101 into the user prepared passage way, the mounting guides 115 hold the sleeve 101 within the user prepared passage way in axial alignment with the user prepared passage way until the adhesive material used to mount the sleeve 101 dries. This prevents the outside surface of the sleeve 101 from being mounted adjacent to the inside surface of said passage way. Thus, the mounting guides aid the user in mounting the sleeve 101 in the center of the passage way. The mounting guides 115 may be inserted through the outside fiberglass shell 8 of a surfboard and the sleeve 101 may be rocked to further center the sleeve 101 within the user prepared passage way. Without the mounting guides 115, the sleeve is free to float in the adhesive material to a position whereby the first outside surface 118 of the sleeve 101 is adjacent to the inside surface of the user prepared passage way. This creates a thin film of adhesive which may chip away during normal use and result in the deterioration of the object. Another undesirable result of the float would be the slippage of the sleeve 101 from its desired position in the passage way while the adhesive material is drying leaving the sleeve 101 protruding or on the floor.

If a thin layer of adhesive is used to mount the sleeve 101 into the object, the thickness of the adhesive near the ends of the sleeve 101 may become thin and brittle. Should the adhesive crack or chip, the inside surface of the long, broad object may become deteriorated. As shown in FIG. 5 the second end 139 of the sleeve 101 has an effective outside diameter less than the outside diameter in the middle of the sleeve 101. This allows a thicker layer of adhesive to accumulate at the end. The sleeve 101 could be fabricated with a step down in outside diameter at each end. Upon mounting of the stepped sleeve 101 into a user prepared passage way 3 in the long, broad object, the steps in the ends of the sleeve 101 allow a thicker application of adhesive which is more resistant to cracking and chipping.

The user should utilize an adhesive material preselected to be compatible the material of the broad, flat object. If said object is a surfboard, a cabisol material is recommended for the adhesive as it may be tinted to a color compatible with the color of the surfboard, and is workable for the time required to insert the sleeve 101 into the user prepared passage way.

The mounting guides 115 shown in FIG. 4 are tapered from top to bottom. The same effect may be achieved by tapering the entire outside of the first outside surface 118 or a preselected portion thereof of sleeve 101 from a preselected outside diameter at or near the second end 139 to a larger outside diameter at or near the first end 138. The wedge shape aids in forcing the adhesive along the passage way between the sleeve 101 and the inside surface of the passage way 3.

The mounting guides 115 fabricated on the first outside surface 118 of the sleeve 101 could be substantially spherical. The radius of the spherical mounting guides is selected to increase the effective outside diameter of the sleeve 101 so that upon insertion of the sleeve 101 into a user prepared passage way 3 in the broad, long object, the mounting guides 115 will press against the inside surface of the user prepared passage way 3 and keep the sleeve 101 secured within the passage way 3 during the drying of the adhesive used to mount the sleeve 101 into the object.

During installation, the user should insert the sleeve 101 second end 139 into the user created passage way from the lower surface 6 toward the upper surface 5. If the passage way is filled with an adhesive, the excess adhesive will be forced up and sideways by the wedge shape of the sleeve 101 resulting in a more complete bonding of the sleeve 101 into the user created passage way 3.

The preferred material used to fabricate the sleeve and plug parts of the arrangements is 30% glass filled polycarbonate because the molded shapes hold their tolerances after cooling and during normal wear and tear. Further, after the user mounts the sleeve and plug into a long, broad and flat object, the plug and sleeve parts of the arrangements may be reduced in length by sanding the ends without experiencing melting or severe feathering of the sanded surfaces. The sanding allows the user to accommodate the arrangement to objects such as surfboards and sailboards which have non-parallel and curved upper and lower surfaces.

FIG. 6 illustrates another embodiment 15 of the present invention. A basic plug 186 has a second outside surface 119 and a second inside surface 109. Walls 187 extend from the outside surface 119 of the plug to the inside surface 109 to form a tab 184 upon which a plurality of ridges 182 may be mounted. Second walls 110 form a catch in the first inside surface 103 of the sleeve 101. The circumferential catch 110 is positioned such that under the condition that the bottom 137 of the plug 186 is adjacent the first end 138 of the sleeve 101, the ridges 182 are in opposition to and engage the circumferential catch 110. The tab 184 flexes during the insertion and removal of the ridges 182 into the catch 110 of the sleeve 101 as depicted in FIG. 7.

FIG. 8 is a top view of the end of the arrangement showing access to the leash pin 135.

Figure 9:
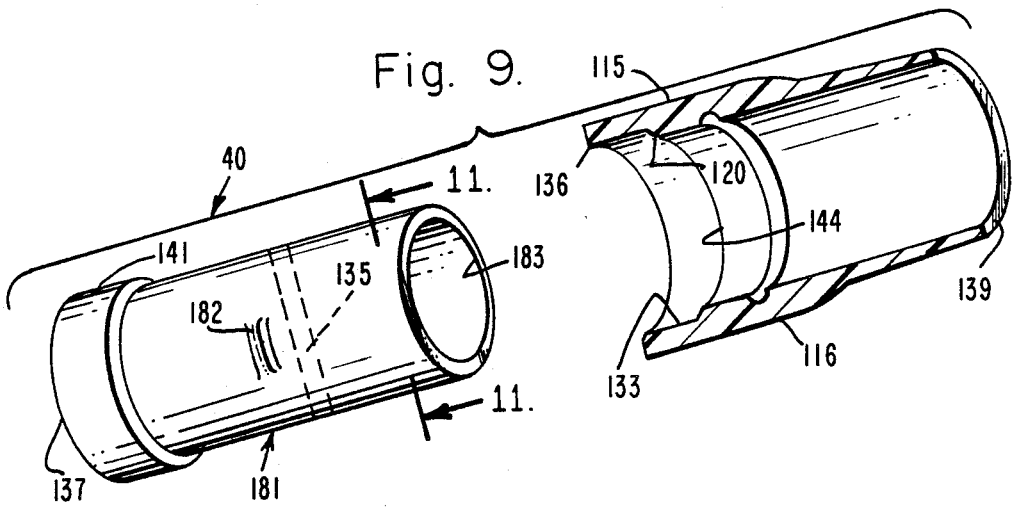
FIG. 9 is a perspective side view of a plug with ridges and a cross sectional perspective view of a sleeve with corresponding catch.
Figure 10:
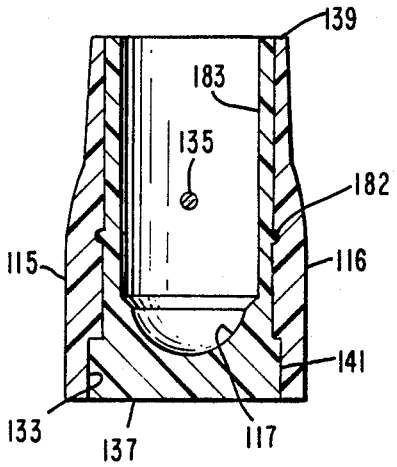
FIG. 10 is a cross sectional view of the plug inserted into the sleeve of FIG. 9.

FIG. 9 shows yet another embodiment 40 of the present invention. A basic plug 181 has a second outside surface 119 and an elliptical inside wall 183. A plurality of ridges 182 are mounted on the outside surface 119 of the plug 181. The ridges 182 are mounted a preselected distance from the bottom 137 of the plug 181 at a position to engage the catch 110 upon the insertion of the plug 181 into the sleeve 101 as depicted in FIG. 10.

Figure 11:
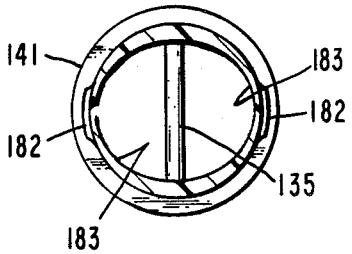
FIG. 11 is a cross sectional view at the ridges showing the shape of the internal surface of the plug inserted into the sleeve of FIG. 9.

FIG. 11 shows a cross sectional view of the plug 181 at the ridges 182. It shows the plug 181 to have an elliptical inside wall 183. The ridges 182 are mounted on the outside surface 119 of the plug 181 adjacent the foci of the ellipse. The thinner portion of the walls adjacent the foci of the ellipse allow the walls to deform during insertion and removal of the ridges 182 into the seat 110 of the sleeve 101.

Figure 12:
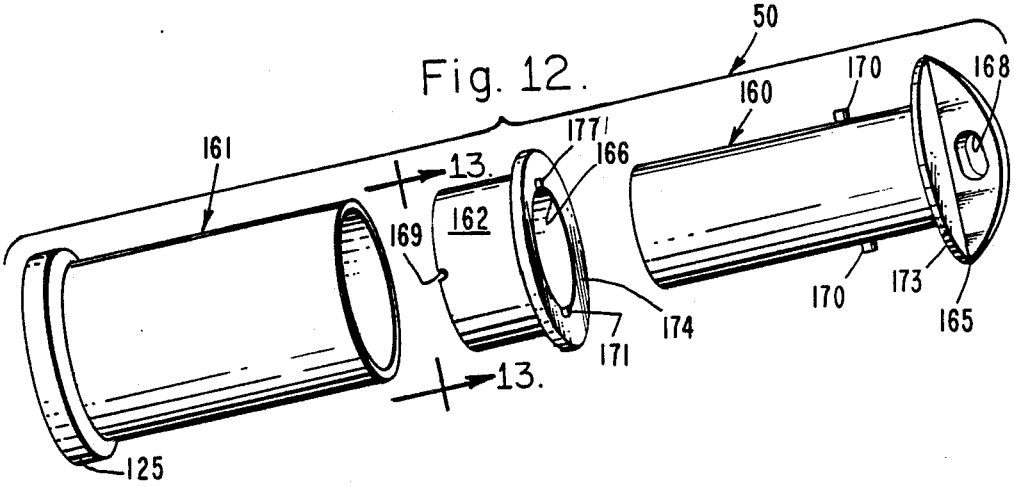
FIG. 12 is a perspective side view of an embodiment of a two piece sleeve and a plug with a leash pin on the top.

FIG. 12 depicts yet another embodiment 50 of the present invention fabricated of a sleeve 161, a top plug 162 and a leash plug 160.

The top plug 162 is fabricated with a first orifice 166 to accommodate the insertion of the leash plug 160 into the orifice 166.

The leash plug 160 contains a pin 170 mounted perpendicular to the axis of the leash plug 160. The length of the pin 170 is selected to provide an extension of the pin 170 on both sides of the leash plug 160. A lip 173 is formed on the end of the leash plug 160. Access to the pin 170 similar to access to leash pin 135 could be provided.

The top plug 162 shown in FIG. 13 contains at least two leash pin guides 171 formed in the inside surface of the first orifice 166 which provide access to the pin stop wall 172. The leash pin stop wall is tapered and ends in a securing slot 168 such that upon insertion of the leash plug 160 into the first orifice 166, the extensions of the pin 170 will fit along the pin guides 171 and the lip 173 will be in contact with the end 174 of the top plug 162. At this position the leash plug 160 with least pin 170 may be rotated by pressing on walls 165 forcing the extensions of the pin 170 along the tapered leash pin stop wall 172, engaging securing slot 169 to secure the leash plug 160 into the top plug 162.

FIG. 14 shows the sleeve 161 mounted by adhesive in a passage way 3 prepared in a long, broad object such as a surfboard. The second flange 125 is flush with the bottom surface 6 of the object. The excess portion of the sleeve 161 above the upper surface 5 is sanded flush with the upper surface 5 of the object. As shown in FIG. 15, the top plug 162 is inserted into the top of the sleeve 161 and glued in position The plug 160 may now be inserted as shown in FIG. 16 and twisted into place. Orifice 168 provides a tie point for the leash. Any extension of the plug 160 below the bottom surface 6 can be sanded off.

FIG. 17 shows another embodiment 20 of the arrangement for a sleeve adapted to distribute the forces experienced by the sleeve during normal use when the sleeve is mounted within a flat object such as the bodyboard which is fabricated from a soft flexible material.

The embodiment 20 is fabricated in a plurality of pieces. The upper sleeve 122 is comprised of a unitarily fabricated body having a basic cylindrical shape of a first preselected outside diameter flaring to a first flange 124 having a diameter selected to be in the range of 1.25 to 4 times said first preselected outside diameter. The multiple selected for the flange 124 diameter is chosen to provide sufficient surface to withstand reasonably expected pressures without pulling out after being inserted into a broad, flat object such as a bodyboard. Some of the bodyboards are created from styrofoam which has a low tensile strength relative to the soft flexible foam used by such manufacturers as "BOOGIE" to make their classic bodyboards. The upper sleeve 122 has a third inside surface generally designated 126 of a preselected inside diameter. A plurality of guide slots 114 are formed in the third inside surface 126.

The lower sleeve 123 of the arrangement 20 is comprised of a unitarily fabricated body having a basic cylindrical shape having an outside diameter preselected to be smaller than the inside diameter of the third inside surface 126 of the upper sleeve 122. The lower sleeve 123 flares to a second flange 125 similar to the first flange 124 described above and having a diameter selected to be in the range of 1.25 to 4 times said second preselected outside diameter. A plurality of mounting guides 115 are formed on the outside surface of the lower sleeve 123. A preselected length of the cylindrical portion of the lower sleeve 123 is insertably removable from the third inside surface 126 of the upper sleeve 122 with the mounting guides 115 fitting into the guide slots 114. This length is preselected to allow the lower sleeve 123 to be inserted into and glued to the upper sleeve 122 from opposite sides of a bodyboard a distance sufficient to allow the first flange 124 to be substantially aligned with the upper surface 5 of the bodyboard and the second flange 125 to be substantially aligned with the lower surface 6 of the bodyboard.

Plug 131 is fabricated in a basic cylindrical shape having a second outside surface 119. Third wall 111 forms a circumferential seat in the second outside surface 119 for the o-ring 112. Pin 105 is mounted in plug 131 and the first end of the pin 105 extends a preselected distance from the outside surface 119 of the plug 131. The second end of the pin 105 does not extend beyond the outside surface 119 of the plug 131. The diameter of the pin 105 and the distance the first end of the pin 105 extends is preselected to be smaller than the width and depth respectively of the guide slot formed by the first walls 104.

The lower sleeve 123 has a fourth inside surface generally designated 127 of a preselected inside diameter larger than the outside diameter of the plug 131. First walls 104 form a guide slot in the fourth inside surface 127 of a preselected width and depth. First stop wall 106 forms the end of the channel.

The first walls 104 are of a preselected length to accommodate the insertion of the plug 131 containing the pin 105 into the guide slot such that under the condition that pin 105 is adjacent to first stop wall 106, the bottom 107 of the plug 131 is substantially aligned with the first end 108 of the lower sleeve 123.

Second wall 110 forms a catch in the fourth inside surface 127 and is positioned such that under the condition that the bottom 107 of the plug 131 is adjacent the first end 108 of the lower sleeve 123, the o-ring 112 will be retained within the catch 110.

The o-ring 112 is fabricated of a flexible material having a preselected circular cross section diameter slightly smaller than the space formed by the seat 111 opposing the circumferential catch 110. The inside diameter of the o-ring 112 is preselected to allow the o-ring 112 to be installed over the plug 131 and rolled into place within the circumferential seat 111.

Typically, the upper surface of a surfboard is not parallel with the lower surface of the surfboard and the two surfaces form a taper. After installation and sanding to conform to the taper, the orientation of the sleeve will not change because the sleeve is adhesively fixed to the surfboard. However, the plug may be inserted in an orientation which is rotated from the initial insertion causing a lip or tip to protrude. Therefore, the embodiment of the plug 131 contains a key such as the pin 105 extending beyond the outside surface of the plug 131. Because of the extension of the pin 105, the plug 131 may be fully inserted into the sleeve 123 in only one orientation, the extending portion of the pin 105 forming a key to engage the guide slot formed by first walls 104.

This concludes the description of a preferred embodiment of the present invention. Those skilled in the art may find many variations and adaptations falling within the scope of this invention, and the appended claims are intended to cover all such variations and adaptations falling within the true scope and spirit of the invention.

What is claimed is:

1. Arrangement for securing a long, broad object having an upper surface spaced apart from a lower surface, to a fixed object comprising:

lockably connecting means;

a sleeve having outside walls, defining a preselected cross section, a first end and a second end, said sleeve axially mountable perpendicular to said long, broad surfaces under the condition of said first end being adjacent to said lower surface and said second end being adjacent said upper surface of said long, broad object, said sleeve including a first wall defining an orifice internal to said sleeve and extending from said first end to said second end having a preselected cross-section to provide an axial passage way for said lockably connecting means through said long, broad object to connect said long, broad object to said fixed object; and a plug of a preselected length and including a bottom portion having a cross-sectional shape which complements but is slightly smaller than said orifice and axially insertably, removable through said orifice into said sleeve at least to a position in which said bottom portion is substantially adjacent to said first end under the condition that the end of said plug opposite said bottom portion is substantially adjacent to said second end.

2. The arrangement defined in claim 1 wherein:

said plug including a second wall defining an inside surface accessible from the end of said plug opposite said bottom portion; and a pin mounted in said plug substantially perpendicular to the axis of said plug, spaced apart from said bottom portion and said end opposite said bottom portion and accessible by said inside surface.

3. The arrangement defined in claim 1 wherein:

said plug including a second wall defining an inside surface accessible from the end of said plug opposite said bottom portion defining a second orifice having a preselected cross-section;

a leash plug of a preselected length and including a top surface having a cross-sectional shape which complements but is slightly smaller than said second orifice and axially insertably, removable from said second orifice at least to a position in which said upper surface is at least substantially adjacent to the upper surface of said long, broad object;

said leash plug including a forth wall defining an inside surface accessible from said top surface; and a leash plug pin mounted in said leash plug substantially perpendicular to the axis of said leash plug, spaced apart from said top surface and said end opposite said top surface and accessible by said inside surface.

4. The arrangement defined in claim 1 wherein:

said sleeve including a stop means engaged under the condition of said bottom portion of said plug being adjacent to said lower surface of said long, broad object.

5. The arrangement defined in claim 1 wherein:

said sleeve including mounting guides of a preselected thickness and mounted on said outside surface of said sleeve and spaced apart from said ends of said sleeve.

6. The arrangement defined in claim 1 wherein:

said sleeve including second walls defining a guide slot of a preselected cross section from said orifice a preselected axial length along said axial passage;

a third wall forming a stop at the end of the guide slot spaced apart from said orifice a preselected distance; and a key having a preselected cross section smaller than said guide slot mounted on the outside surface of said plug at a position such that under the condition of said key being adjacent to said stop, the bottom of said plug is substantially adjacent to said lower surface of said long, broad object.

7. The arrangement defined in claim 1 wherein:

said plug including catch means mounted on said plug.

8. The arrangement defined in claim 7 wherein:

said sleeve including a latch means mounted on said sleeve and engagable by said catch means under the condition of said bottom portion being substantially adjacent said lower surface of said long, broad object.

9. The arrangement defined in claim 8 wherein:

said plug including second walls defining a circumferential seat in the outside surface of said plug spaced apart from said bottom portion;

said catch means is an o-ring mounted in said circumferential seat;

said sleeve including third walls of a preselected inside diameter smaller than the outside diameter of said o-ring defining a latch wall opposing the o-ring under the condition of said bottom portion of said plug being substantially adjacent said lower portion of said long, broad object; and a chamfer formed in the end of said latch stop nearest said first end of said sleeve.

10. The arrangement defined in claim 8 wherein:

said plug including second walls defining a circumferential seat in the outside surface of said plug spaced apart from said bottom portion;

said catch means is an o-ring mounted in said circumferential seat; and said sleeve including third walls defining a seat in said first wall and mounted to be in opposition to said circumferential seat under the condition of said bottom portion of said plug being substantially adjacent said lower portion of said long, broad object.

11. The arrangement defined in claim 8 wherein:

said catch means including a plurality of ridges mounted on the outside surface of said plug and spaced apart from said bottom portion a preselected distance; and said sleeve including third walls defining a seat in said first wall and mounted to be in opposition to and engaged by said ridges under the condition of said bottom portion of said plug being substantially adjacent said lower portion of said long, broad object.

12. The arrangement defined in claim 11 wherein:

said plug including a second wall defining an inside surface having an elliptical cross section and said ridges are mounted on the outside surface nearest the foci of said elliptical inside cross section.

13. The arrangement defined in claim 11 wherein:

said plug including a second wall defining an inside surface not accessible from said bottom portion; and said plug including forth walls extending from the outside surface of said plug to said inside surface defining a plurality of tabs spaced apart from said bottom portion with said ridges being mounted on the outside surface of said tabs.

14. The arrangement defined in claim 1 wherein:

said sleeve including second walls defining a first step having an outside diameter smaller than the outside diameter of said sleeve and extending a preselected distance from one of said ends of said sleeve.

15. The arrangement defined in claim 14 wherein:

said sleeve including third walls defining a second step having an outside diameter smaller than the outside diameter of said sleeve and extending a preselected distance from the end opposite the end having said first step.

16. The arrangement defined in claim 1 wherein:

a preselected length of the outside surface of said sleeve tapers from a first preselected outside diameter to a second preselected outside diameter smaller than said first outside diameter.

17. The arrangement defined in claim 1 wherein:

said sleeve is unitarially constructed in a substantially cylindrical shape of a preselected material.

18. The arrangement defined in claim 1 wherein:

said sleeve is constructed of a plurality of insertably connectable pieces.

19. The arrangement defined in claim 18 wherein:

the insertably connectable piece adjacent one of said surfaces of said long, broad object including a flange mounted on the end of said piece being adjacent to said surface.

20. The arrangement defined in claim 18 wherein:

the insertably connectable piece adjacent said upper surface includes a first flange mounted on the end of said piece adjacent to said upper surface; and the insertably connectable piece adjacent said lower surface includes a second flange mounted on the end of said piece adjacent to said lower surface.

21. The arrangement defined in claim 1 wherein:

said sleeve including second walls defining a first guide slot of a preselected cross section from said orifice a preselected axial length along said axial passage;

said sleeve including third walls defining a second guide slot of a preselected cross section smaller than said first guide slot from said orifice a preselected axial length along said axial passage;

a forth wall forming a first stop at the end of said first guide slot spaced apart from said orifice a preselected distance;

a fifth wall forming a second stop at the end of said second guide slot spaced apart from said orifice a preselected distance;

a first key having a preselected cross section smaller than said first guide slot an mounted on the outside surface of said plug;

a second key having a preselected cross section smaller than said second guide slot an mounted on the outside surface of said plug at a position such that as said plug is inserted into said sleeve engaging said first key with said first guide slot, said second key engages second guide slot; and said keys mounted at a position on said plug such that said plug will insert into said sleeve under the condition of at least one of said keys being adjacent to at least one of said stops, the bottom of said plug is substantially adjacent to said lower surface of said long, broad object.

22. Arrangement for securing a long, broad object having an upper surface spaced apart from a lower surface, to a fixed object comprising:

lockably connecting means;

a sleeve unitarially constructed of a preselected material having outside walls, defining a preselected cross section, a first end and a second end, said sleeve axially mountable perpendicular to said long, broad surfaces under the condition of said first end being adjacent to said lower surface and said second end being adjacent said upper surface of said long, broad object, said sleeve including a first wall defining an orifice internal to said sleeve and extending from said first end to said second end having a preselected cross-section to provide an axial passage way for said lockably connecting means through said long, broad object to connect said long, broad object to said fixed object;

said sleeve including mounting guides of a preselected thickness and mounted on said outside surface of said sleeve and spaced apart from said ends of said sleeve;

said sleeve including second walls defining a guide slot of a preselected cross section from said orifice a preselected axial length along said axial passage;

said sleeve including a latch means mounted on said sleeve;

said sleeve including forth walls defining a first step having an outside diameter smaller than the outside diameter of said sleeve and extending a preselected distance from one of said ends of said sleeve;

said sleeve including fifth walls defining a second step having an outside diameter smaller than the outside diameter of said sleeve and extending a preselected distance from the end opposite the end having said first step; and a preselected length of the outside surface of said sleeve tapers from a first preselected outside diameter to a second preselected outside diameter smaller than said first outside diameter;

a plug of a preselected length and including a bottom portion having a cross-sectional shape which complements but is slightly smaller than said orifice and axially insertably, removable through said orifice into said sleeve at least to a position in which said bottom portion is substantially adjacent to said first end under the condition that the end of said plug opposite said bottom portion is substantially adjacent to said second end;

said plug including a sixth wall defining an inside surface accessible from the end of said plug opposite said bottom portion;

said sleeve including a stop means engaged under the condition of said bottom portion being adjacent to said lower surface of said object;

said stop means including a third wall forming a stop at the end of the guide slot spaced apart from said orifice a preselected distance;

said plug including a key having a preselected cross section smaller than said guide slot mounted on the outside surface of said plug at a position such that under the condition of said key being adjacent to said stop means, the bottom of said plug is substantially adjacent to said lower surface of said long, broad object;

said plug including catch means mounted on said plug and engaging said latch means under the condition of said bottom portion being substantially adjacent said lower surface of said long, broad object;

said catch means including seventh walls defining a circumferential seat in the outside surface of said plug spaced apart from said bottom portion; and an o-ring mounted in said circumferential seat;

said sleeve including seventh walls defining a seat in said first wall and mounted to be in opposition to said circumferential seat under the condition of said bottom portion of said plug being substantially adjacent said lower portion of said long, broad object; and, a pin mounted in said plug substantially perpendicular to the axis of said plug, spaced apart from said bottom portion and said end opposite said bottom portion and accessible by said inside surface.

23. Arrangement for securing a long, broad object having an upper surface spaced apart from a lower surface, to a fixed object comprising:

lockably connecting means;

said sleeve is constructed of a plurality of insertably connectable pieces, the insertably connectable piece adjacent said lower surface including a first flange mounted on the end of said piece adjacent to said lower surface and the insertably connectable piece adjacent said upper surface including a second flange mounted on the end of said piece adjacent to said upper surface;

said plurality of insertably connectable pieces having outside walls, defining a preselected cross section, a first end and a second end and axially mountable perpendicular to said long, broad surfaces under the condition of said first end and second flange being adjacent to said lower surface and said second end and second flange being adjacent said upper surface of said long, broad object;

said sleeve including a first wall defining an orifice internal to said sleeve and extending from said first end to said second end having a preselected cross-section to provide an axial passage way for said lockably connecting means through said long, broad object to connect said long, broad object to said fixed object;

said sleeve including mounting guides of a preselected thickness and mounted on said outside surface of said sleeve and spaced apart from said ends of said sleeve;

said sleeve including second walls defining a guide slot of a preselected cross section from said orifice a preselected axial length along said axial passage;

said sleeve including a latch means mounted on said sleeve;

a preselected length of the outside surface of said sleeve tapers from a first preselected outside diameter to a second preselected outside diameter smaller than said first outside diameter;

a plug of a preselected length and including a bottom portion having a cross-sectional shape which complements but is slightly smaller than said orifice and axially insertably, removable through said orifice into said sleeve at least to a position in which said bottom portion is substantially adjacent to said first end under the condition that the end of said plug opposite said bottom portion is substanitally adjacent to said second end;

said plug including a forth wall defining an inside surface accessible from the end of said plug opposite said bottom portion;

said sleeve including a stop means engaged under the condition of said bottom portion being adjacent to said lower surface of said object;

said stop means including a third wall forming a stop at the end of the guide slot spaced apart form said orifice a preselected distance;

said plug including a key having a preselected cross section smaller than said guide slot mounted on the outside surface of said plug at a position such that under the condition of said key being adjacent to said stop means, the bottom of said plug is substantially adjacent to said lower surface of said long, broad object;

said plug including catch means mounted on said plug and engaging said latch means under the condition of said bottom portion being substantially adjacent said lower surface of said long, broad object;

said catch means including fifth walls defining a circumferential seat in the outside surface of said plug spaced apart from said bottom portion; and an o-ring mounted in said circumferential seat;

said sleeve including third walls of a preselected inside diameter smaller than the outside diameter of said o-ring defining a latch wall opposing the o-ring under the condition of said bottom portion of said plug being substantially adjacent said lower portion of said long, broad object;

a chamfer formed in the end of said latch stop nearest said first end of said sleeve; and, a pin mounted in said plug substantially perpendicular to the axis of said plug, spaced apart from said bottom portion and said end opposite said bottom portion and accessible by said inside surface.

* * * * *